United States Patent [19]

Tench et al.

[11] Patent Number: 4,948,042

[45] Date of Patent: Aug. 14, 1990

[54] COMPRESSED AIR SPRAY GUN ADAPTED FOR USE WITH MORE THAN ONE CANISTER

[76] Inventors: Rex D. Tench, Rt. 1, Box 183, Stanley, N.C. 28164; Elmer J. Hager, Rt. 2, Box 756, Denver, N.C. 28037

[21] Appl. No.: 384,403

[22] Filed: Jul. 21, 1989

[51] Int. Cl.[5] ..... B05B 7/30; B05B 7/04

[52] U.S. Cl. ..... 239/113; 239/307; 239/346

[58] Field of Search ..... 239/113, 303, 304, 307, 239/340, 346

[56] References Cited

U.S. PATENT DOCUMENTS

| | | | |
|---|---|---|---|
| 1,863,782 | 6/1932 | Young | 239/428 X |
| 1,948,401 | 2/1934 | Smith et al. | 239/305 X |
| 3,084,871 | 4/1963 | Puglis . | |
| 3,091,402 | 5/1963 | Palmer . | |
| 3,135,467 | 6/1964 | Greenman | 239/304 |
| 3,322,350 | 5/1967 | Heinicke . | |
| 4,397,422 | 8/1983 | Gwyn | 239/307 |
| 4,567,912 | 2/1986 | Levine . | |
| 4,723,712 | 2/1988 | Egli et al. | 239/307 |

*Primary Examiner*—Andres Kashnikow
*Assistant Examiner*—William Grant
*Attorney, Agent, or Firm*—Bell, Seltzer, Park & Gibson

[57] ABSTRACT

An improved compressed air spray gun includes a conventional compressed air spray head unit connected to a mounting block. The mounting block is fabricated from an integral block of material and includes radially extending passageways intersecting within a medial portion of the mounting block and communicatively connecting at their intersection point with an outlet on the upper face of the mounting block which communicatively connects with the fluid inlet of the spray head unit. The passageways extend outwardly through the mounting block to form outlets on the peripheral side edge portions of the block. Fluid inlet ports are positioned on the lower face of the mounting block and extend into the block and communicate with respective ones of the passageways. Each fluid inlet port has connected thereto a fluid holding canister. A valve means is positioned in each of the radially extending passageways and controls the amount of fluid which can be delivered from an individual fluid holding canister so that the flow of fluid from each of the canisters can be individually and selectively regulated to spray singly or in combination the fluids contained within each canister.

10 Claims, 2 Drawing Sheets

COMPRESSED AIR SPRAY GUN ADAPTED FOR USE WITH MORE THAN ONE CANISTER

FIELD OF THE INVENTION

This invention relates to compressed air spray guns, and more particularly to compressed air spray guns adapted for multi-canister use.

BACKGROUND OF THE INVENTION

Fine automotive finishing and artistic paint finishing such as commonly applied on the sides of some automobiles or vans, requires a coordination of different colors, shades or layers of paint to give the desired end finish. For example, three different coats of paint often are applied to an automobile. A base coat and then a microflake coat typically are applied to the automobile, followed by a protective coating of clear, automotive finish. Typically, between each different paint coat, a new spray gun adapted for use with a different paint must be prepared or the liquid-holding canister, i.e. cup as commonly referred, is removed from the spray head unit and a new canister which contains a different paint therein, secured to the unit. The use of a different compressed air spray gun for each color or coating is cost prohibitive. Changing the canister on a single spray head unit for each color or coating could be less expensive. However, this is time consuming and can become bothersome to an operator.

Some compressed air spray guns, such as found in U.S. Pat. Nos. 1,863,782 to Young; 1,948,401 to Smith et al; and 3,135,467 to Greenman, incorporate different attachments which provide for multiple canister use on a single spray head unit. Although these devices do provide an enhanced paint spraying operation by eliminating the need for using two or more air spray guns or repeatedly changing cups between coats, there is an apparent limitation in their use. Cleaning of each device is difficult after use. Both Smith and Young have integral branch pipes or tubes which are difficult to clean and can clog easily. Additionally, the housing or cover securing the multiple canisters lessens the efficiency of the spray gun operation because the vacuum draw in the integrally connected branch pipes or tubes is lessened. Also, the complexity in the design of these devices makes their manufacturing more difficult and their designs do not readily accommodate the use of conventional paint canisters.

The device disclosed in Greenman does not suffer from a vacuum loss because it uses a positive pressure system where each canister is pressurized and the liquid contained is forced under pressure into the spray head unit. The amount of liquid or paint flowing from each canister into the spray head unit can be regulated so that various shades or hues can be produced by mixing various colors of paint during spray. This device also has apparent limitations. Because the canisters are pressurized, additional air pipes and air pressure chambers are required in the main structure to induce pressure to the paint canisters. Additionally, this device discloses a complex valve unit controlling the flow of paint from each canister. Each valve unit includes at least a valve pin, compression spring, valve pin guide and washers. Not only do the large number of parts and complexity of the design increase manufacturing costs, but also cleaning of the apparatus is made more difficult because a larger number of parts, such as in the valve unit, must be disassembled from the main structure and then reassembled.

It is therefore a primary object of this invention to provide a compressed air spray gun adapted for multi-canister use and which includes a mounting block for securing thereto conventional liquid-holding canisters and a spray head unit such as commonly used in the industry and which provides selective and individual regulation of fluid flow from the canisters into the spray head unit.

It is another object of this invention to provide a compressed air spray gun adapted for multi-canister use and which includes a mounting block for securing thereto conventional liquid-holding canisters and a spray head unit such as commonly used in the industry and which is simple in design to facilitate cleaning and reduce manufacturing costs and which provides selective and individual regulation of fluid flow from the canisters into the spray head unit.

It is another object of this invention to provide a compressed air spray gun adapted for multi-canister use and which includes a mounting block for securing thereto conventional liquid-holding canisters and a spray head unit such as commonly used in the industry and which provides selective and individual regulation of fluid flow from the canisters into the spray head unit by valve means which is simple in design and includes few parts.

SUMMARY OF THE INVENTION

These and other objects of the present invention are accomplished by the improved compressed air spray gun in accordance with the present invention. The spray gun includes a spray head unit having a nozzle outlet, a compressed air connection means adapted for communicatively connecting to a compressed air line, and a fluid inlet means adapted for communicatively connecting to a fluid line or fluid holding canister and adapted to draw liquid upwardly therethrough by a vacuum and mix with compressed air to be discharged from the nozzle. The spray head unit is mounted and secured onto an integral mounting block having upper and lower faces and peripheral side edge portions. An outlet is included on the upper face in a medial portion thereof and extends into the mounting block. The outlet is communicatively connected to the fluid inlet means of the spray head unit. The mounting block includes therein a plurality of radially extending liquid flow passageways intersecting within the medial portion of the mounting block. The passageways are communicatively connected at their intersection point thereof with the outlet on the upper face of the mounting block.

A plurality of fluid inlet ports are positioned on the lower face of the mounting block in spaced relation to each other and to the peripheral side edge portions. The fluid inlet ports extend into the mounting block and communicate with respective ones of the radially extending passageways. A plurality of fluid holding canisters having connection means for removable connection and communication to a spray head unit or fluid line are individually and removably connected by the connection means to individual ones of the fluid inlet ports so that a fluid flow path is established from each of the canisters, through a respective passageway communicating therewith and into the spray head unit. A valve means is positioned in each of the radially extending passageways for controlling the amount of fluid which can be delivered from an individual fluid holding canister into a radially extending passageway communicating therewith and into the spray head unit. The flow of fluid from each of the canisters can be selectively regulated to spray singly or in combination the fluids contained within each canister.

In the preferred embodiment, the radially extending passageways extend completely through the mounting block to form respective openings along side edge portions. The openings are counterbored so that the diameter of the counterbore is greater than the diameter of the radially extending passageway so as to form a valve seat thereat. The fluid inlet ports individually communicate with individual ones of the counterbores. A valve control shaft having a frusto-conical inner end is positioned in each counterbore along the peripheral side edge portions of the mounting block and is adapted to move in a range of positions from an inmost position where the inner end engages the valve seat to seal same and a range of extended positions so that the clearance between the frusto-conical inner end and the valve seat is varied wherein the flow of fluid from each of the canisters can be selectively regulated to use singly or in combination the fluids contained in each canister.

BRIEF DESCRIPTION OF THE DRAWINGS

Some of the objects and advantages of the present invention having been stated, others will be more fully understood from the detailed description which follows and by reference to the accompanying drawings.

DETAILED DESCRIPTION OF THE PREFERRED EMBODIMENT

Figure 1:
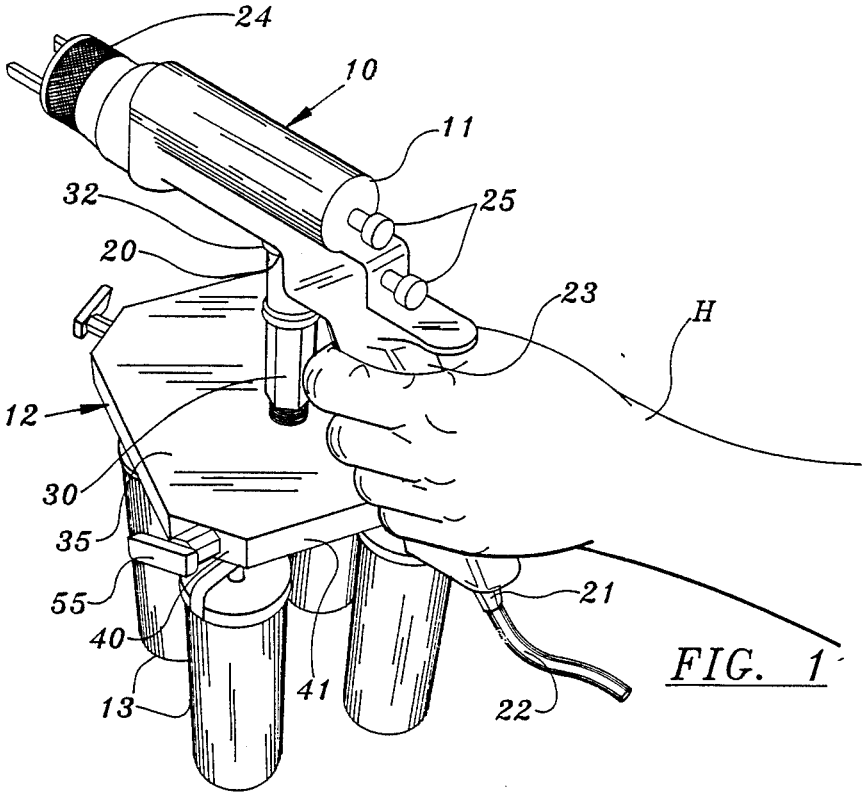
FIG. 1 is a true perspective of the compressed air spray gun in accordance with the present invention shown manually grasped by an operator.
Figure 2:
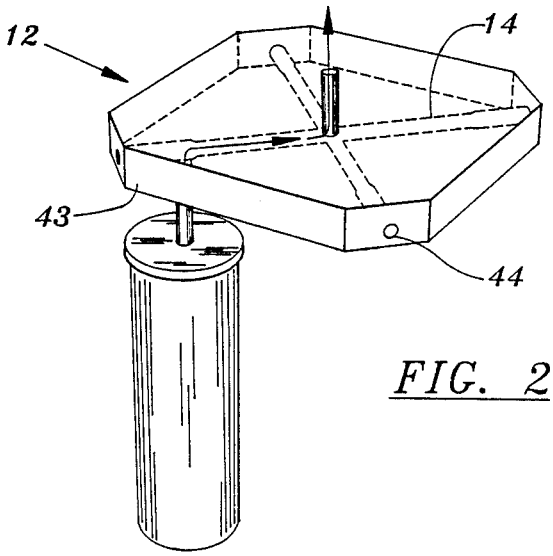
FIG. 2 is a diagrammatic true perspective view showing the liquid flow relationship between a canister and the mounting block.

Referring now to the drawings, and more particularly to FIG. 1, there is shown the improved compressed air spray gun 10 in accordance with the present invention. The compressed air spray gun includes a conventional spray head unit 11 attached to the mounting block 12 of the present invention. Four fluid holding canisters 13 or cups as conventionally termed, such as used in the industry for holding paints and other liquids therein, are secured to the underside of the mounting block 11. As will be explained later in detail, a fluid flow path is established from each canister into radially, extending passageways 14 in the mounting block and into the spray head unit 11 (FIG. 2) and the fluid flow from each canister 13 can be controlled by individual valve control shafts 15 cooperating with each radially, extending passageway 14 (FIG. 3).

The spray head unit 11 can be of any type adapted for manual manipulation by an operator's hand H and which also includes a threaded fluid inlet nipple 20 located on the under body of the unit 11 for attachment thereto of a conventional cup or paint line and a compressed air connection 21 on the longitudinally extending handle for attachment thereto of a compressed air line 22. The compressed air flows through the handle 23 of the unit to a mixing area (not shown) therein. Normally, in most conventional operations the compressed air is forced outwardly through the nozzle 24 and draws fluid upwardly into the unit 11 from the canisters or paint line attached to the fluid inlet connection and into the mixing area. As is conventional, the spray head unit 11 includes adjusting screws 25 to adjust the mixing of the paint and compressed air in the mixing area and effect changes in atomization and fluid flow. An example of the conventional spray head units are those manufactured by Sharpe Manufacturing Company and Binks Manufacturing Company, such as a Sharpe Model No. 775 or a Binks No. 7.

As illustrated, an elongated extension member 30 interconnects the spray head unit 11 and the mounting block 12. As is conventional, the extension member 30 has an axial bore 31 therethrough and includes a conventional threaded top receiving cup 32 and a threaded bottom end 33. The threaded top receiving cup is threaded onto the fluid inlet nipple 20 on the spray head unit 11 to secure same thereto. The threaded bottom end 33 is received into a threaded outlet 34 medially located on the upper face 35 of mounting block 12 (FIG. 4) which, as will be explained later, communicates with the radially extending passageways 14.

Figure 4:
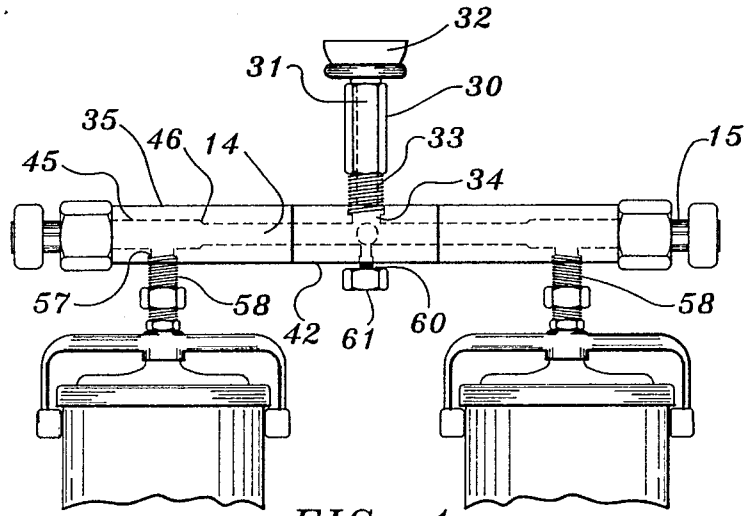
FIG. 4 is a side view of the mounting block having the canisters attached thereto.
Figure 5:
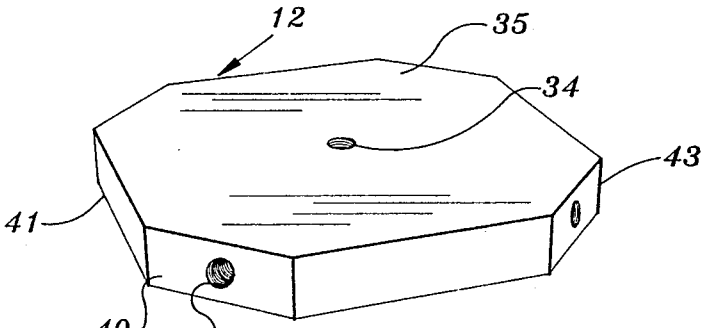
FIG. 5 is an isometric view of the mounting block.
Figure 3:
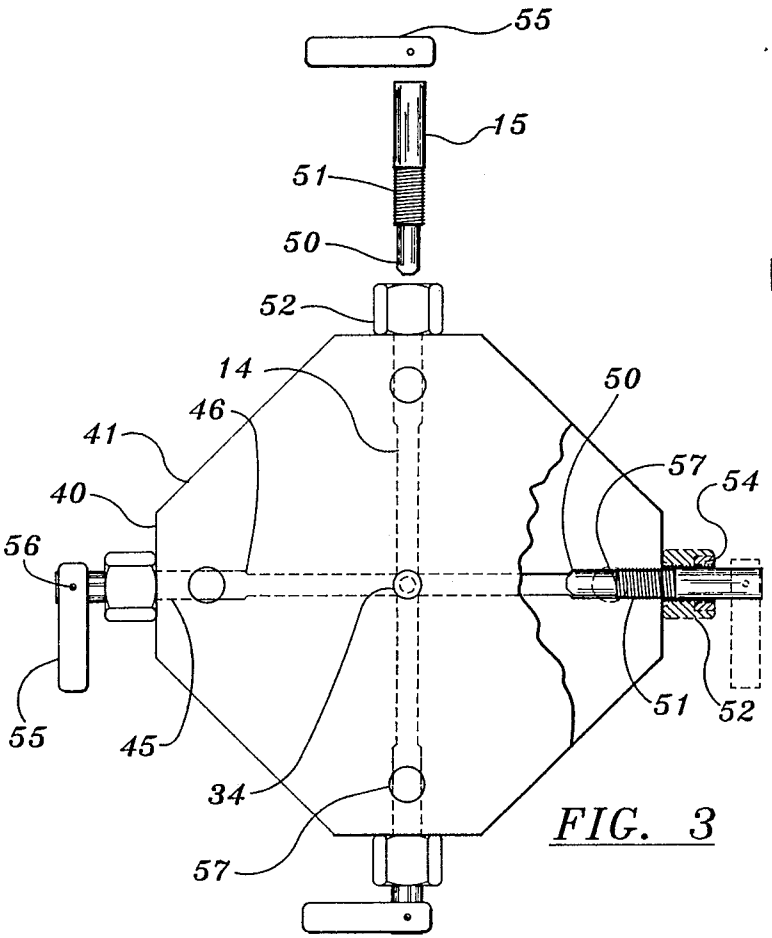
FIG. 3 is a partial breakaway, plan view sectional of the mounting block showing the positional relationship between the radially extending passageways, counterbores and valve control shafts.

Referring now more particularly to FIGS. 3–5, there is shown in detail the mounting block 12 in accordance with one preferred construction. The mounting block 12 is of integral construction and is substantially octagonally shaped having respective short and long sides 40, 41 and which define side edge portions 43. The mounting block 11 preferably is formed from an integral piece of aluminum which gives it high strength to sustain the heavy use and handling imparted during automotive and industrial painting, but also is of light weight to facilitate manual handling. The mounting block 12 includes spaced and substantially parallel, upper and lower faces 35, 42 and the peripheral side edge portions 43, extend substantially perpendicular to the parallel faces. It has been determined that a block approximately four inches wide and approximately one half inch in thickness is suitable for use with the present invention. As noted before, the outlet 34 included on the upper face 35 in a medial portion thereof is communicatively connected to the fluid inlet nipple 20 of the spray head unit 11 by means of the extension member 30.

As shown schematically in FIG. 3, the mounting block includes four radially extending liquid flow passageways 14 which extend completely through the mounting block 12 to form respective openings 44 along the short side 40 of peripheral side edge portions 43. Although only four passageways are illustrated, the number can vary depending on the size of the mounting block and the number of canisters mounted thereon. Each passageway 14 extends substantially parallel with upper and lower faces 35, 42 and intersect each other within a medial portion of the mounting block 12. The passageways 14 communicatively connect at their intersection point thereof with the outlet 34 on the upper face 35 of the mounting block 12. Although the passageway diameter can vary it preferably is 3/16 inch diameter so as to minimize resistance to the vacuum draw, but not weaken the integrity of the mounting block. The openings 44 along the peripheral side edge portions 43 are counterbored so that the diameter of the formed counterbore 45 is greater than the diameter of the respective radially extending passageway 14 so as to create a slight lip thereat forming a valve seat 46 adjacent each of the openings 44 (FIG. 4). Preferably, each counterbore 45 is approximately ¼ inch in diameter and extends about ½ inch to ¾ inch into the passageway 14. The counterbore creates a slight lip 46 within the passageway which forms a valve seat thereat.

As noted before, each opening 44 includes a valve control shaft 15 positioned therein. The inner end 50 of the shaft 15 is frusto-conically shaped and dimensioned to frictionally engage the valve seat 46 such as illustrated in FIG. 3. Each shaft 15 includes a threaded medial portion 51 dimensioned for threadable engagement with the counterbore which also includes internal threads dimensioned for receipt of the shaft 15. As illustrated, nuts 52 are secured to the peripheral side edge portion 43 in coaxial relationship with the counterbores 45. The nuts can be secured to the peripheral side edge portions by means of a threaded extension member (not shown) integral with the mounting block, or other means conventional to the industry. The nuts aid to engage neoprene seals 54 against the shafts to prevent fluid loss out from the radially extending passageways and around the shafts 15 when the air spray gun is in use. A swivel arm 55 is connected on the outer end of each valve control shaft 15 by a pin 56. The swivel arm 55 facilitates manual rotation of the shaft to move the shaft as it rotates axially within the counterbore.

As shown in FIG. 4, four fluid inlet ports 57 are positioned on the lower face 42 of the mounting block 12 and extend upwardly therethrough to individually communicate with individual ones of the counterbores 45. The fluid inlet ports 57 are threaded and dimensioned so as to receive therein the screw attachments 58 of a conventional paint canister fluid holding canister 13, i.e. paint cup as commonly referred in the industry. Each canister 13 preferably is of the variety typically used with artistic, ornamental spray guns. Although a larger canister could be used if a larger mounting block were utilized, the smaller canisters are preferred because they are lighter and more easily handled. As illustrated, the canisters form a substantially square configuration when mounted to the block 12 so as to balance the weight of the canisters across the block 12. If more than four canisters are used, the canisters can be arrayed in a more circular pattern instead of a square pattern. As shown in FIG. 1, the extension member 30 connecting the mounting block 12 and spray head unit 11 is dimensioned along its height so that end of the spray head unit handle 23 is positioned substantially planar with the mounting block 12. This facilitates handling and balancing of the spray gun 10 when manually grasped by an operator.

To facilitate cleaning of the mounting block 12 after its use, an additional outlet 60 is provided on the lower face 42. This outlet 60 extends through the mounting block 12 substantially perpendicular to upper and lower faces 35, 42 to interconnect the outlet 60 on the upper face thereof. The additional outlet 60 aids in flushing the mounting block 12 of paint or liquid which has dried in the radially extending passageways. Liquid paint remover or other liquid cleaner can be inserted into the mounting block from either outlet when the canisters 13 and spray head unit 11 are removed. When the spray gun 10 is in use, a bolt-like closure 61 is screwed into the lower face outlet 60 to prevent paint or other liquid flowing in the mounting block from flowing through the bottom face outlet (FIG. 4).

In accordance with the present invention, the improved compressed air spray gun allows selective regulation of the flow of paint or other liquid contained within each canister 13. The compressed air flowing through the spray head unit 11 mixes in the mixing chamber of the unit and flows outwardly from the nozzle 24 while simultaneously creating a vacuum draw in the mounting block radially extending passageways 14 to draw paint or other fluid contained in the canisters 13 upwardly therethrough. If the shafts positioned in each counterbore 45 are moved inwardly so that the frusto-conical inner ends 50 engage the valve seats 46 thereat, the vacuum draw is cut and paint or other fluid contained in each canister cannot flow through respective passageways 14 and into the spray head unit 11. By selectively turning the valve control shafts 15, the amount of paint withdrawn from each canister block can be regulated. The clearance formed between the frusto-conical inner end 50 and valve seat 46 allows measured amounts of fluid to flow into each radially extending passageway and subsequently to the spray head unit 11. If each canister contains different colored paints, the amount of mixing between paints can be regulated to form various colors.

The improved spray gun 10 in accordance with the present invention is an improvement over other prior art devices which are adapted for multicanister use. The vacuum draw in the mounting block 12 is not restricted such as in other prior art devices. Also, after use of the spray gun 10, the canisters 13 and spray head unit 11 can be readily removed, and the valve control shafts 15 can be rotated outwardly from the mounting block 12 and removed therefrom. The mounting block 12 can be inserted into a bucket or other container (not shown) holding cleaning fluid. The passageways can be air blown clean and dried. Other prior art devices which have more complex valve control systems which are more difficult to remove can be damaged by solvents if left intact during cleaning.

The foregoing embodiment is to be considered illustrative rather than restrictive of the invention and those modifications which come within the meaning and range of equivalence of the claims are to be included therein.

That which is claimed is:

1. An improved compressed air spray gun comprising a spray head unit having a nozzle outlet, a compressed air connection means adapted for communicatively connecting to a compressed air line, and a fluid inlet means adapted for communicatively connecting to a fluid line or fluid holding canister and adapted to draw liquid upwardly therethrough by a vacuum draw and mix with compressed air to be discharged from the nozzle outlet, an integral mounting block having upper and lower faces and peripheral side edge portions and an outlet on the upper face in a medial portion thereof and extending into said mounting block, said outlet communicatively connected to said fluid inlet means of said spray head unit, said mounting block including therein a plurality of radially extending passageways, extending into and through said mounting block and intersecting at said medial portion of said mounting block, and communicatively connecting at their intersection point thereof with said outlet on the upper face of said mounting block, a plurality of fluid inlet ports positioned on the lower face of said mounting block in spaced relation to each other and to said peripheral side edge portions, said fluid inlet ports extending into said mounting block and communicating with respective ones of said radially extending passageways, a plurality of depending fluid holding canisters having connection means for removable connection and communication to a spray head unit or fluid line to allow fluid or paint contained in said canister to be drawn upward by vacuum, said canisters being individually and removably connected by said connection means to individual ones of said fluid inlet ports so that a fluid flow path is established from each of said canisters through a respective passageway communicating therewith and into said spray head unit, and a valve means positioned in each of said radially extending passageways for controlling the amount of fluid which can be delivered from an individual fluid holding canister into the mounting block, whereby the flow of fluid from each of said canisters can be selectively regulated to spray singly or in combination the fluids contained within each canister.

2. The improved compressed air spray gun according to claim 1 wherein said outlet on the upper face of said mounting block extends through said mounting block to form an outlet on the lower face of said mounting block to facilitate cleaning of said radially extending passageways within said mounting block when said fluid holding canisters and spray head unit are removed therefrom by providing an additional outlet to aid in flushing the mounting block of paint or other like material which has dried within said radially extending passageways, and including closure means removably connected to said lower face outlet to prevent paint and other fluid from passing through said lower face outlet when the spray gun is in use.

3. The improved compressed air spray gun as claimed in claim 1 wherein said spray head unit includes a longitudinally extending handle portion depending therefrom and having a terminus end thereon, an extension member having an axial bore therethrough, said extension member interconnecting said upper face mounting block outlet and said fluid inlet means of said spray head unit so that said axial bore communicates with said upper face outlet and said fluid inlet means, said extension member being of a height so that the terminus end of said handle is positioned so as to be substantially planar with said mounting block to facilitate handling of said improved compressed air spray gun by allowing an enhanced balance of said spray gun when manually grasped by an operator.

4. The improved compressed air spray gun according to claim 1 wherein said fluid holding canisters are removably secured to said mounting block in a square pattern so that the width across the square is substantially the width across the mounting block.

5. An improved compressed air spray gun comprising a spray head unit having a nozzle outlet, a compressed air connection means adapted for communicatively connecting to a compressed air line, and a fluid inlet means adapted for communicatively connecting to a fluid line or fluid holding canister, an integral mounting block having spaced and substantially parallel, upper and lower faces and peripheral side edge portions extending substantially perpendicular to said parallel faces, an outlet on the upper face in a medial portion thereof and extending into said mounting block, said outlet communicatively connected to said fluid inlet means of said spray head unit, said mounting block including therein a plurality of radially extending liquid flow passageways which extend completely through said mounting block to form respective openings along peripheral side edge portions, said passageways extending substantially parallel with upper and lower faces and intersecting at said medial portion of said mounting block, and communicatively connecting at their intersection point thereof with the outlet on the upper face of said mounting block, said openings along peripheral side edge portions being counterbored so that the diameter of said counterbore is greater than the diameter of said radially extending passageway so as to form an outwardly extending lip thereat and creating a valve seat adjacent each of said openings, each counterbored opening including therein a valve control shaft having an outer end and a frusto-conical inner end which is dimensioned to frictionally engage the valve seat, each valve-control shaft being movable within said counterbore from an innermost position where the frusto-conical inner end engages the valve seat to seal the same thereat, and a range of extended positions where the clearance between the frusto-conical inner end and the valve seat is varied, a plurality of fluid inlet ports positioned on the lower face of said mounting block in spaced relation to each other and to said peripheral side edge portions, said fluid inlet ports extending into said mounting block and communicating with respective ones of said counterbores, a plurality of depending fluid holding canisters such as a paint canister having connection means for removable connection and communication to a spray head unit or fluid line to allow fluid or paint contained in said canister to be drawn upward by vacuum through said canister and into said spray head unit or paint line, said canisters individually and removably connected by said connection means to individual ones of said fluid inlet ports so that a fluid flow path is established from each of said canisters through respective passageways communicating therewith and into said spray head unit whereby the flow of fluid from each canister can be selectively regulated to spray singly or in combination the fluids contained therein when the air spray gun is in use by selectively moving each valve control shaft in a desired range of positions to adjust the clearance between the inner end of each shaft and the valve seat to regulate the amount of liquid flowing therethrough.

6. The improved compressed air spray gun according to claim 5 including means threadably mounting said fluid inlet means of the spray head unit to the outlet of the mounting block.

7. The improved compressed air spray gun as claimed in claim 5 including fluid seal means engaging said shafts to prevent fluid loss out from said radially extending passageways and around said shafts when the air spray gun is in use.

8. The improved compressed air spray gun as claimed in claim 7 including nuts aiding to engage said fluid seal means to said shafts.

9. The improved compressed air spray gun according to claim 5 including means threadably mounting said canisters into said fluid inlet ports.

10. A compressed air spray gun attachment adapted for use with a compressed air spray head unit having a nozzle outlet, a compressed air connection means adapted for communicatively connecting to a compressed air line, and a fluid inlet means adapted for threadable engagement and communication with a fluid line or fluid holding canister, and adapted for selectively regulating singly or in combination the flow of liquid from a plurality of fluid holding canisters having connection means for removable connection and communication to a spray head unit or other fluid line, the attachment comprising an integral mounting block having spaced and substantially parallel, upper and lower faces and peripheral side edge portions extending substantially perpendicular to said parallel faces, an outlet on the upper face in a medial portion thereof and extending into said mounting block, said outlet including internal threads therein and dimensioned to threadably receive therein the fluid inlet means of a conventional compressed air spray head unit, said mounting block including therein a plurality of radially extending liquid flow passageways, said passageways extending completely through said mounting block to form respective openings along peripheral side edge portions, said passageways extending substantially parallel with upper and lower faces and intersecting at said medial portion of said mounting block and communicatively connecting at their intersection point thereof with the outlet on the upper face of said mounting block, said openings along peripheral edge portions being counterbored so that the diameter of said counterbore is greater than the diameter of said radially extending passageway so as to form an outwardly extending lip thereat and creating a valve seat adjacent each of said openings, a plurality of fluid inlet ports positioned on the lower face of said mounting block in spaced relation to each other and to said peripheral side edge portions, said fluid inlet ports extending into said mounting block and communicating with respective ones of said counterbores, said fluid inlet ports being adapted for receipt therein of the connection means of the conventional fluid holding canisters, each counterbored opening including therein a valve control shaft having an outer end and a frusto-conical inner end which is dimensioned to frictionally engage the valve seat, each shaft being movable within said counterbore from an innermost position where the frusto-conical inner end engages the valve seat to seal the same thereat, and a range of extended positions where the frusto-conical inner end is positioned off the valve seat so that the clearance between the frusto-conical inner end and the valve seat is varied so that when liquid holding canisters and a spray head unit are attached thereto, the flow of fluid from each of the fluid holding canisters can be individually and selectively regulated.

* * * * *